United States Patent [19]

Wheeler

[11] 4,187,064

[45] Feb. 5, 1980

[54] ROTARY MACHINE

[76] Inventor: Colin Wheeler, 14 Hope Rd., Applecross, Australia, 6153

[21] Appl. No.: 825,787

[22] Filed: Aug. 18, 1977

[30] Foreign Application Priority Data

Aug. 19, 1976 [AU] Australia ..... PC7062

[51] Int. Cl.[2] ..... F04C 27/00

[52] U.S. Cl. ..... 418/187; 418/186; 418/245; 418/248

[58] Field of Search ..... 418/186, 187, 244, 245, 418/248, 125, 129

[56] References Cited

U.S. PATENT DOCUMENTS

| | | | |
|---|---|---|---|
| 349,888 | 9/1886 | Knebel | 418/248 X |
| 389,328 | 9/1888 | Sleigh | 418/186 |
| 664,486 | 12/1900 | Lestrade | 418/245 |
| 1,900,784 | 3/1933 | Zint | 418/187 |
| 2,232,951 | 2/1941 | Kosian | 418/187 |
| 2,507,151 | 5/1950 | Gabriel | 418/186 X |
| 3,244,157 | 4/1966 | Tanferna et al. | 418/245 X |
| 3,426,694 | 2/1969 | Marsh | 418/186 |

FOREIGN PATENT DOCUMENTS

| | | | |
|---|---|---|---|
| 110515 | of 1875 | France | 418/245 |

*Primary Examiner*—Leonard E. Smith

*Attorney, Agent, or Firm*—Finnegan, Henderson, Farabow & Garrett

[57] ABSTRACT

A rotary machine including an outer housing, and a cam-shaped rotor mounted within said housing for rotation about an axis coincident with the axis of the housing with two sealing members for the rotor equally supported at diametrically opposed positions within the housing for movement toward and away from the peripheral surface of the rotor and in at least close sealing proximity with the adjacent surface of the rotor during at least part of the rotation of the rotor, the lobe portion of the rotor being at least in close sealing proximity with an adjacent inner surface of the housing, an inlet passage through said rotor and opening through the surface thereof on one side of said lobe portion, an exit passage also passing through the rotor and opening through the surface thereof on the other side of said lobe portion, said inlet and exit passages communicating with ports for admitting working fluid to, and exhausting working fluid from, said rotor. Also disclosed is a twin rotor arrangement in which two rotors are supported within the housing on a common support shaft and separated by a partition wall with the respective lobe portions and sealing members being at diametrically opposed positions within the housing to dynamically balance the forces within the machine.

11 Claims, 5 Drawing Figures

ROTARY MACHINE

Figure 1:
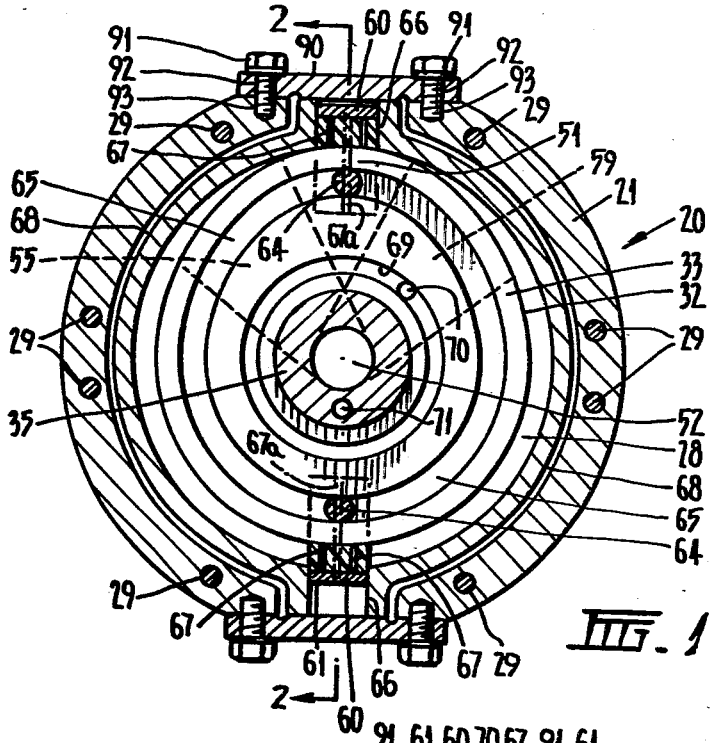

This invention relates to a rotary machine, for example, a rotary engine, compressor, pump, motor, brake or the like.

A rotary machine according to the present invention has the advantage that, when applied in the form of a engine, rotary power is being produced for most, if not all, of the full cycle of the engine, or alternatively when adapted to form a compressor or pump, the fluid is pressurized or pumped for substantially, if not all, of the working cycle of the machine at a constant or near constant rate. Further advantages with the present invention are the fact that the engine incorporates fewer moving parts than for conventional positive action rotary machines of the type in question, whilst its direction of rotation or fluid flow is also easily reversible. Furthermore, the sealing members which are incorporated in the rotary machine of the present invention enable the maintenance of steady flow conditions and perform a positive sealing action within the machine. As a fluid pump, for example, for air or gas, the machine can supply substantially oil free air or gas whilst running it very low or high rotational speeds and relatively high torque, and, when applied in the form of an engine or motor utilising an externally produced working medium such as hot gas or steam, or as a motor driven by hydraulic fluid, the machine is capable of producing high torque at relatively low revolutions per minute.

In accordance with the present invention there is provided a rotary machine including an outer housing, an annular surface in said housing and having a longitudinal axis, at least one rotor in said housing and rotatable about an axis coincident with the annular surface, said rotor having an outer surface including at least one sealing portion disposed in close sealing relation with the annular surface, said rotor surface having convexly curved cam surface portions on either side of said at least one sealing portion, said cam surface portion each merging into a segmental surface portion of the rotor surface concentric with the annular surface, at least two sealing members supported upon said housing and equally spaced around the annular surface, each said sealing member having a surface confronting said rotor outer surface and forming a sealing surface, said sealing surface being complementary to the segmental surface portion of said rotor for sealing engagement therewith, said sealing surface being noncomplementary to the sealing portion and the cam surface portions of said rotor, means causing each said sealing member to move to position its sealing surface in sealing engagement with the segmental surface portion of said rotor when adjacent thereto, an inlet passage opening to the outer surface of said rotor predominantly through a cam surface portion and partly through a segmental surface portion on one side of said at least one sealing portion, an exit passage opening to the outer surface of said rotor predominantly through a cam surface portion and partly through a segmental surface portion on the other side of said at least one sealing portion, said inlet and exit passages communicating with ports for admitting working fluid to and exhausting working fluid from said housing, respectively, the length of the inlet and outlet passage openings at the outer rotor surface, when measured in the direction of rotor rotation, being greater than the length of the sealing surface for each said sealing member, whereby said inlet and outlet passages are continuously open to a respective working space between the rotor and the housing thereby maintaining substantially continuous and constant admission and exhaustion of working fluid during rotation of said rotor, the distance between the leading end of the opening of a said outlet passage and the trailing end of the opening of the inlet passage on the opposite side of the intervening segmental surface being greater than the distance between any pair of adjacent sealing members, whereby the inlet and outlet passages on either side of the intervening segmental surface portion will not be simultaneously open to the same working space between the pair of sealing members, the length of the at least one sealing portion of said rotor, when measured in the direction of rotor rotation, being greater than the length of the sealing surfaces for each sealing member, each said sealing member having at least one port therethrough opening through said sealing surface at one end and into a space within said housing at the surface of said sealing member opposite said sealing surface, whereby when each said sealing member is in sealing engagement with a majority of a said segmental surface portion of said rotor there will be no fluid flow through said port, but when each said sealing member is aligned with an inlet or outlet passage opening, including that part of the opening through said segmental surface portion, fluid flow occurs through said port to equalize fluid pressure at said sealing surface and said opposite surface of said sealing member.

According to one preferred form of the invention the rotor is generally cam-shaped, with the outermost part of its lobe portion at the periphery of the rotor being adapted to move in at least close proximity with the internal circumferential surface of the housing. Preferably the outermost part of the lobe portion moves in sliding sealing engagement with the internal circumferential surface of the housing.

In the preferred embodiment, the housing carries two or more sealing members which are equally spaced around the housing and are constrained to move radially inwardly and outwardly of the housing in guides, whilst means are provided to maintain the sealing members in close proximity to the peripheral surface of the rotor.

Preferably the radius of curvature of the outer part of the lobe matches the radius of curvature of the inner circumferential surface of the housing.

Each sealing member may be mounted on a support member extending radially inwardly of the rotor adjacent at least one side face thereof and carries at its inner end a bearing pin adapted to engage within a cam groove in the side face of the rotor whereby rotation of the rotor will cause the sealing member to execute the radially inwardly and outward movements in synchronism with the rotation of the rotor. Alternatively, the sealing members may be biased inwardly into engagement with the periphery of the rotor by compression springs between the sealing members and the outer ends of the guides within the housing. In a still further alternative the sealing members may be forced inwardly and outwardly by appropriate mechanical linkage arrangement also operating in cooperative synchronism with the rotation of the rotor. A still further alternative would be to use fluid pressure, such as gas or oil under pressure, supplied through pipes and ports to the area behind the outer ends of the sealing members within the guides in the housing, or the movement of the sealing members may be synchronisly timed by strategic positioning of the openings to, and from, the inlet and oulet passages with respect to the rotor and the positions of the sealing members. Sliding sealing engagement, or close sealing proximity, between the sealing members and the peripheral surface of the rotor need only be maintained during critical periods of rotation of the rotor, when leakage of fluid (e.g. combustion gases, air or hydraulic fluid) past a particular sealing member must be avoided as will be apparent from the following description of the preferred embodiments.

As an alternative to utilising a cam shaped rotor with the openings to the inlet and exit passages being on either side of the lobe portion thereof at the periphery of the rotor, with radially inwardly and outwardly moving sealing members, it is within the spirit of the invention to form the working spaces within the machine adjacent the, or each, side surface of the rotor as distinct from the peripheral surface thereof, in which case the cam shaped rotor is not used and a bulge is formed on one, or both, side surfaces of the rotor with the inlet and exit passage openings being provided on either side of the bulge, whilst the sealing members are supported by guides in the adjacent internal side surfaces of the housing.

Figure 2:
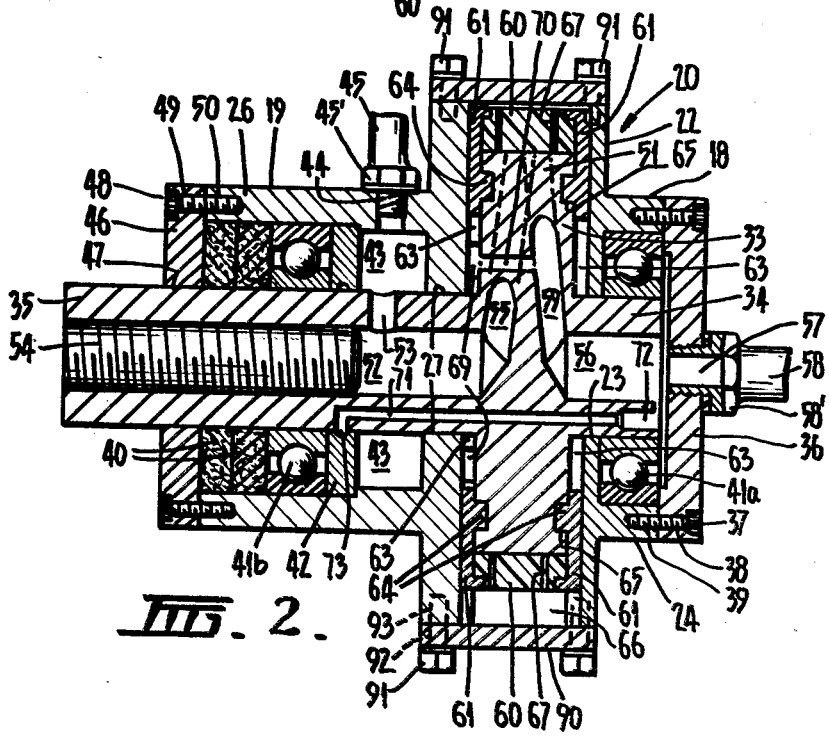
Figures 3, 4:
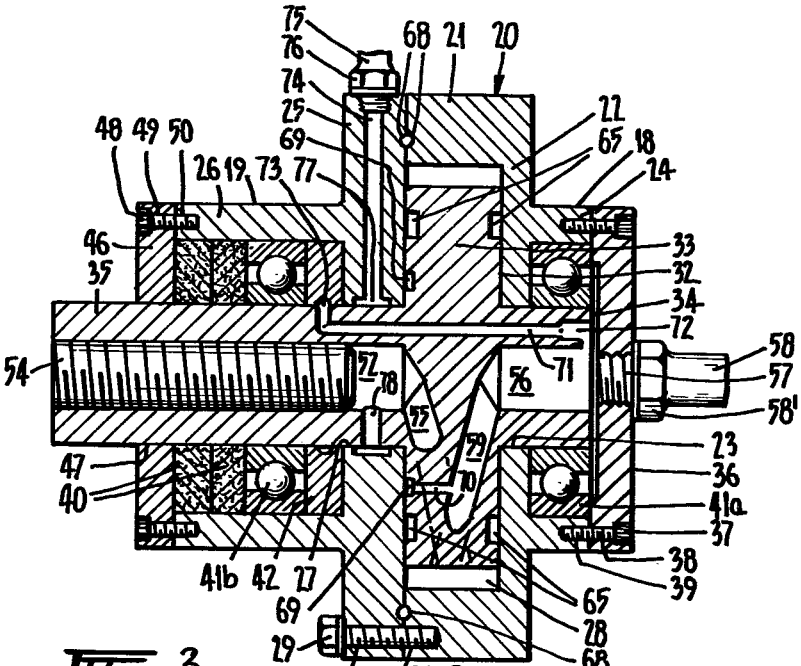
Figure 5:
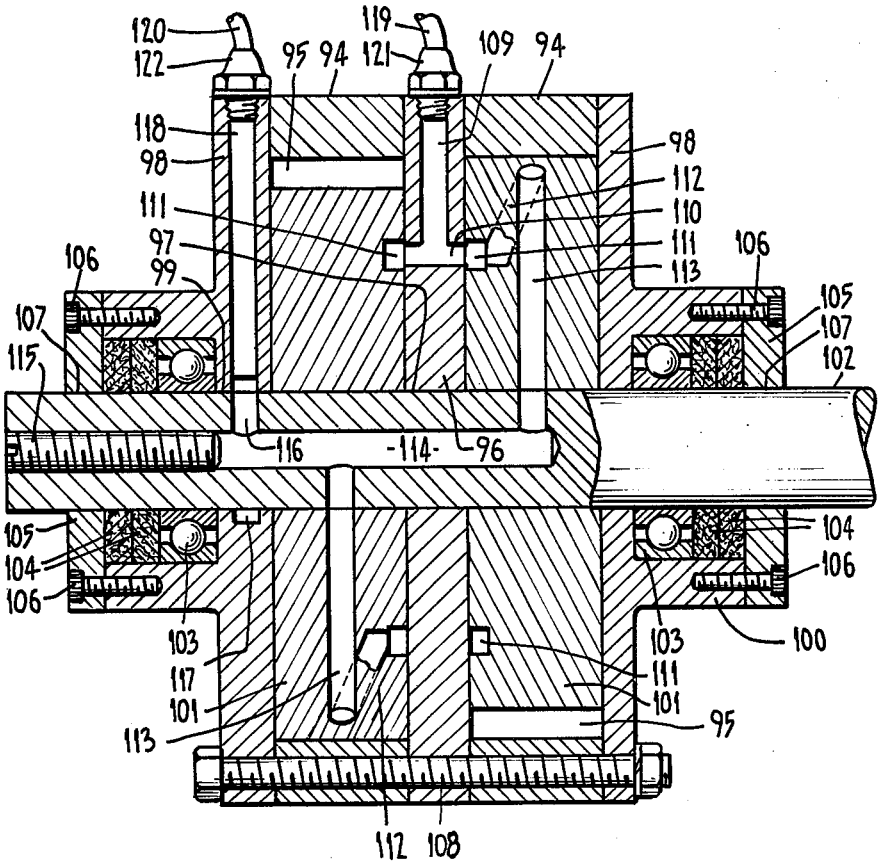

Three preferred forms of the invention, as particularly applied in the form of a pump, compressor, brake or motor will now be described with reference to the accompanying drawings in which:

FIG. 1, is an end cross-sectional view of a first of the preferred forms of the invention, FIG. 2, is a side cross-sectional view taken along line 2—2 of FIG. 1, FIG. 3, is a side cross-sectional view of a second preferred form of the invention, FIG. 4, is a side cross-sectional view of a third preferred form of the invention, and FIG. 5, is a side cross-sectional view of a twin rotor unit in accordance with a preferred form of the present invention.

In the three preferred forms of the invention with reference to FIGS. 1 to 4 of the drawings, the machine comprises a housing generally indicated as 20 having a first housing section 18 forming one end of the machine (hereinafter referred to as the exit end of the machine) and comprising a generally cylindrical outer wall 21 (shown in the embodiment of FIG. 3) one side of which is closed by an integral annular side wall 22 with the central circular bore 23 therethrough coincident with the axis of rotation of the machine, whilst a further integral cylindrical wall 24 is provided extending outwardly of the external side of the wall 22 and radially outwardly spaced from the hole 23 as shown, and with an axis also coincident with the rotation axis of the machine. The housing 20 is completed by a second section 19 forming the other side of the machine (hereinafter referred to as the inlet end of the machine), and comprises an annular side wall 25 with a central circular hole 27 therethrough coincident with the axis of rotation of the machine whilst an integral cylindrical wall 26 is provided extending outwardly from the external side of the wall 25 and radially outwardly spaced from the hole 27 as shown with its axis also coincident with the rotation axis of the machine. The first and second housing sections 18 and 19 are joined together to form an internal cylindrical cavity 28, by bolts 29 (see FIG. 3), passing through holes 30 adjacent the peripheral edge of the side wall 25 of the second section 19 and received within threaded holes 31 in the adjacent annular face of the cylindrical outer wall 21 of the first section 18.

A rotor 32 is positioned within the cavity 28 in the housing 20, and comprises a main rotor body 33 of cam shaped configuration and two support shafts 34 and 35, the shorter one 34 of which passes through the holes 23 in the first housing section 18 and terminates adjacent the outer end of the cylindrical section 24. The annular space between the inner surface of the cylindrical wall 24 and the external surface of the shaft 34 receives an exit end main bearing **41*a*, whilst the outer end of the cylindrical wall 24 is closed by a circular closure member 36 attached by bolts 37 passing through holes 38 in the closure plate 36 and received within threaded holes 39 in the annular end surface of the cylindrical wall 24. The second of the two support shafts 35 is of a larger length than the support shaft 34 and passes through the hole 27 in the side wall 25 of the second housing section 19. The annular space between the inner surface of the cylindrical wall 26 and the external surface of the shaft 35 receives a pair of packing seals 40 adjacent its outer end, adjacent which seals in inlet end main bearing 41*b* is positioned, and adjacent the inner side of which a by-pass sleeve or member 42, in the case of the embodiments of FIGS. 1 to 3, is provided, with the remainder of the annular space, in the case of the embodiment of FIGS. 1 and 2, forming an annular inlet cavity 43 communicating with an inlet port 44 directed radially through the cylindrical wall 26 and adapted for connection to an inlet conduit 45 via a connection 45'. An inlet end annular closing plate 46 closes the outer end of the cylindrical wall 26 and has an axial hole 47 through the center thereof through which the extreme end of the shaft 35 extends, and which is bolted by bolts 48 passing through holes 49 in the closure member 46 and received within threaded holes 50 in the annular end surface of the cylindrical wall 26**.

As shown the main rotor body 33 is of a cam-shaped configuration and has a lobe portion 51, part of the outermost peripheral surface of which is in close sealing engagement with the internal surface of the outer wall 21 of the combined housing 20 as shown in FIG. 1, whilst the side surfaces of the main rotor body 33 are in close sliding sealing engagement with the internal surfaces of the side walls 22 and 25 of the housing as shown. The rotor shaft 35 on the inlet end of the machine is provided with an axial inlet transfer passage 52, in the case of the embodiments of FIGS. 1 to 3, which, in the case of the embodiment of FIGS. 1 and 2, is in fluid communication with the annular inlet cavity 43 via a transfer port 53. For convenience of manufacture the axial inlet transfer passage 52 is formed by drilling an axial hole from the end of the shaft 35 and thereafter plugging the inlet end of that axial hole with the plug 54. The inner end of the axial transfer passage 52 communicates with the generally radially outwardly directed transfer passage 55 through the main rotor body 33, which passage opens outwardly at the periphery of the main rotor body 33 on one side of the lobe portion 51. The rotor shaft 34 on the exit end of the machine, in the case of the embodiments of FIGS. 1 to 3, is provided with an exit transfer passage 56 which communicates at the extreme end of the shaft 34 with an exit port 57 provided through the end closure member 36, which in turn is adapted for connection to an exit conduit 58 via a connector 58'. The inner end of the axial transfer passage 56 communicates with a generally radially outwardly directed transfer passage 59, which passage 59 opens outwardly of the periphery of the main rotor body 33 on the opposite side of the lobe portion 51 to that of the inlet transfer passage 55.

A pair of sealing members 60 are supported at diametrically opposed positions within the housing 20 such as to execute radially inward and outward movements to maintain contact with the peripheral surface of the main rotor body 33 as it rotates. As shown the sealing members 60 are supported within and guided by guide slots 66 through the wall 21 of the housing. Furthermore the length of the peripheral surface of the part of the lobe portion of the rotor 33 which is in sealing contact with the inner circumferential surface of the housing is greater than the width of the sealing members 60 in order to prevent leakage as the part of the lobe portion passes the guide slot 66. The housing 20 adjacent the outer end of the guide slots 66 has flat surfaces machined thereon and the outer ends of the guide slots are closed by cover plates 90 attached by bolts 91 passing through holes 92 in the cover plates and received in threaded holes 93 in the side walls 22 and 25. With the embodiments of FIGS. 1 to 3, in order to force the sealing members 60 to move inwardly and outwardly in response to the rotation of the rotor 33 and therefore maintain sliding sealing contact with the peripheral surface thereof, each sealing member 60 is mounted on a pair of L-shaped support members 61 one leg of each of which extends across the outwardly directed end of the sealing member 60, and the other leg of which extends radially inwardly of the rotor down one side face thereof as shown in a guide slot 63 formed in the internal surfaces of the side walls 22 and 25 of the housing and their innermost ends carry a bearing pin 64 which engages in a cam groove 65 formed in the side faces of the main rotor body 33 and which substantially match the shape of the periphery of the rotor such that the sealing member 60 will be pulled inwardly and pushed outwardly in synchronism with the distance between the peripheral surface of the rotor 33 and the sealing members 60 as the rotor rotates. The bearing pin and cam groove arrangement may act directly to draw the sealing members inwardly whilst the rotor surface itself acts to force the sealing members outwardly to avoid the cost of forming a precisely shaped cam groove.

As will be apparent from the following description, sliding sealing engagement, or close sealing proximity, between the sealing members 60 and the peripheral surface of the rotor body 33 need only be maintained during critical periods of the rotation of the rotor 33 where leakage of fluid must be avoided.

The peripheral surface of the rotor 33, with the exception of the outermost part of the lobe portion 51 is spaced inwardly of the internal surface of the housing and is equally spaced therefrom, and therefor circular, for approximately half its perimeter, and it is over this surface that close sealing engagement between the sealing members and the surface of the rotor should be maintained. The lobe portion forms the remainder of the perimeter, whereby the spacing over the leading and trailing surfaces of the lobe portion 51 are spaced progressively nearer the internal surface of the housing 20 towards the outermost point of the lobe portion 51. Furthermore, the radius of curvature of the outermost part of the lobe portion 51 matches the radius of curvature of internal circumferential surface of the housing 20, whilst the inwardly directed surface of each sealing member 60 which is, at least for some of the rotation of the rotor in sliding sealing engagement with the peripheral surface of the rotor, is curved to match the curvature of the circular portion of the rotor 33. The openings for the inlet and exit passages 55 and 59 are elongated as will be apparent from FIG. 1 and extend adjacent, but not over, the outermost part of the lobe portion 51 to balance pressure on either side of each sealing member 60 whilst it is in contact with the sections of the lobe portions 51 and moving radially, thus avoiding excessive friction and loss of efficiency. Such elongated openings would also allow escape of fluid which would otherwise be trapped between the leading side of the lobe portion 51 and the trailing side of the sealing member 60 after the opening to the exit transfer passage 59 has passed the sealing member 60.

With the preferred form of the invention of FIGS. 1 and 2, utilising only a pair of diametrically opposed sealing members 60 and acting as a compressor or pump, with the rotor positioned with the lobe portion 51 in advance of a first of the sealing members 60 in the sealing position considering rotation in the clockwise direction as viewed in FIG. 1, the opening from the inlet transfer passage 55 will allow a fluid medium, such as gas or oil, to be drawn through the inlet port 44 and into the annular inlet cavity 43 and thereafter through the port 53 and axial transfer passage 52, to enter the continuously increasing space produced between the leading surface of the first sealing member 60, the internal surface of the housing 20, the trailing peripheral surface of the rotor 33 and the outermost part of the lobe portion 51. As the rotor 33 continues to rotate the lobe portion 51 passes the diametrically opposite second sealing member 60. With the second sealing member in a sealing position, the opening from the inlet transfer passage 55 then acts in a similar fashion by allowing the fluid medium to be drawn into the continuously increasing space between the leading surface of the second sealing member, the inner surface of the housing 20, the trailing peripheral surface of the rotor 33 and the outermost part of the lobe portion 51. The fluid medium trapped between the first and second sealing members in the preceding stage remains briefly trapped therein with no volume change or change in position until the lobe portion 51 moves towards the first sealing member and this member moves into a non-sealing position. The fluid is then contained in the space between the leading peripheral surface of the rotor 33, the trailing surface of the second sealing member 60, the internal surface of the housing 20, and the outermost part of the lobe portion 51, and this space progressively decreases in volume to thereby, in the case of the embodiment of FIGS. 1 and 2, force the fluid out through the exit transfer passages 59 and 56 to be expelled therethrough as the lobe portion 51 rotates. For all of the rotation of the rotor suction or intake is being generated on one side of the lobe portion 51 behind the outermost part thereof, fluid may be trapped for portion of the cycle in portion of the chamber between the sealing members 60, and fluid from an earlier intake or suction stage is being pumped under pressure from the space on the other side of the lobe portion 51 in front of the outermost part thereof. Therefore, one suction and one pumping stage have been carried out simultaneously twice for each one revolution of the rotor 33, and suction and pumping throughout each revolution is substantially continuous. As a hot air, steam or hydraulic engine or motor, with the inlet transfer passage 55 in advance of a first of the sealing members 60 in the sealing position, considering rotation in the clockwise direction as viewed in FIG. 1, the hot gas or steam expands into, or the hydraulic fluid under pressure enters, the space produced between the leading surface of the first sealing member 60, the inner surface of the housing 20, the trailing peripheral surface of the rotor 33 and the outermost part of the lobe portion 51, forcing the rotor to rotate. After the lobe portion 51 rotates past the second sealing member 60, and this sealing member reaches the sealing position, the inlet passage acts in a similar fashion by allowing the working fluid to expand into or enter the space between the leading surface of the second sealing member 60, the inner surface of the housing 20, the trailing peripheral surface of the rotor 33 and the outermost part of the lobe portion 51. The fluid trapped between the first and second sealing members in the preceding stage remains trapped therein with no volume change or change in position until the lobe portion 51 moves towards the first sealing member, and this member adopts a non-sealing position, and the working fluid contained between the leading peripheral surface of the rotor 33, the trailing surface of the second sealing member 60, the internal surface of the housing 20 and the outermost part of the lobe portion 51, and as this space progressively decreases in volume the working fluid is exhausted through the exit passage 59. For all of the rotation of the rotor working fluid expands or is forced into the space on one side of the rotor to produce power or thrust, fluid from an earlier stage is trapped between the sealing members 60, and fluid from a still earlier stage is being exhausted from the space on the other side of the lobe. Therefore for each one revolution of the rotor 33 two power and exhausting stages have been carried out one exhaust and one power stage for each revolution simultaneously with exhaust and power being substantially continuous. The elongated inlet and outlet openings from the passages 55 and 59, or the relief grooves (not shown), also allow the passages to be uncovered and to finish their fluid transfer functions slightly earlier or later respectively, to thereby increase the time for which the passages allow transfer of fluid. Furthermore, if the grooves are effectively longer than the width of the sealing members 60 power and/or pumping will be applied during the whole of each revolution of the rotor 33. Also pressure is balanced each side of the sealing member when the member is in motion, thus reducing friction and energy loss.

The sealing members 60 incorporate ports 67 extending from the inner sides to the outer sides thereof to allow flow of fluid between the space adjacent the inner side of each member 60 and the space adjacent the outer side during movement of the member 60. Thus fluid movement occurring at one side of the seal is compensated for by an opposite movement of fluid on the other side of the member 60 and thus movement of the member 60 does not effect the volume of fluid being swept during operation of the machine which would result in pulsations in the fluid flowing outwardly of the machine. As an additional advantage where the working fluid within the machine is a fluid having lubricating properties, that lubrication will be facilitated over most of the sliding surfaces of the members. Ports 67 also allow pressure to be balanced on inner and outer sides of the sealing members. The L-shaped support members 61 also include radially extending relief grooves 67*a* in the outwardly facing side faces thereof as shown in FIG. 1 to prevent blockages particularly when the working fluid is oil. Furthermore the rate of volume displacement is not related to the shape of the lobe portion 51, as the sealing members 60 seal only over that portion of the rotor 33 which is in the form of an arc of a circle. The volume at any instance is proportional to the length of the circular arc on peripheral surface of the rotor between the edge of the sealing member and the beginning of the non-sealing surface of the rotor. The space between the non-sealing surface of the rotor and the adjacent sealing member is a non-active space not related to the rate of volume displacement.

In order to provide for sealing between the mating surfaces of the two housing sections 18 and 19 matching annular grooves 68 are formed in the adjacent surfaces of the housing sections which are to be mated when the housing is assembled, and these grooves are filled with liquid rubber which sets to form seals between the two mating surfaces.

When the machine is acting as a pump or compressor the high pressure side of the machine is at the exit end of the machine and as such considerable side thrust is given to the rotor 33 at the exit end of the machine resulting in friction and associated heat losses at the side face of the rotor 33 adjacent the internal surface of the wall 25. In the embodiments of FIGS. 1 to 3, in order to balance or oppose this side thrust an annular groove 69 of approximately equal cross-sectional area to the end of the shaft 34 is machined into the opposite side face of the rotor 33 and is linked via a relief passage 59 in the rotor and thus supplies a substantially identical and opposing force to balance the side thrust.

In the situation when the action of the machine is reversed in which case the high pressure side of the machine becomes the low pressure side and vice versa, a loss of oil and blowing of the packing seals 40 will occur unless the pressure on the seals is relieved and the oil escaping is channelled back to the low pressure side (in this situation the exit end of the machine). This problem is overcome, in the embodiments of FIGS. 1 to 3, by providing an oil by-pass line 71 with a valve chamber 72 in which a valve (not shown) is positioned, whilst the by-pass sleeve or member 42 has a circumferentially extending recess 73 formed in the internal surface thereof surrounding the shaft 35 of the rotor such that oil escaping under pressure between the housing 20 and sleeve 42 and the rotor shaft 35 (clearances as low as 0.0003 of one inch) cannot build up pressure and blow the seals 40 or leak past the seals 40, due to the fact that such build up in oil pressure will be by-passed back to the low pressure side via the by-pass line 71. The valve (not shown) enclosed in the valve chamber 72 is adjusted to open at a pressure less than the maximum pressure that the oil seals will take, and may be adjustably spring loaded to achieve this result.

The embodiment of FIG. 3 differs from the embodiment of FIGS. 1 and 2 only insofar as the manner in which fluid is supplied to the inlet transfer passages 52 and 55. FIG. 3 represents a cross-section taken at right angles to the direction of lobe and outside the plane of the sealing members and as such neither the lobe or the sealing members are visible in this view. In the embodiment of FIG. 3, the inlet cavity 43 is dispensed with and the annular space between the shaft 35 and the cylindrical wall 26 totally accommodates the packing seals 40, input end bearing 41*b* and by-pass sleeve 42. In this embodiment fluid is introduced to the machine via a radially extending passage 74 passing through the sidewall 25 of the housing 20 as shown, the outer end of which passage is connected to an input conduit 75 via a connector 76. The inner end of the passage 74 is in fluid communication with an annular groove 77 formed in the inner surface of the sidewall 25 and extending thereabout, which groove in turn is in fluid communication with the axial transfer passage 52 via a port 78 through the wall of the shaft 35. In all other respects the construction and operation of the machine whether as a pump or compressor, or motor, is as described above for the embodiment of FIGS. 1 and 2 of the drawings, and the same reference numerals are used where appropriate.

The embodiment of FIG. 4 differs from both the embodiments of FIGS. 1 to 3, in relation to the manner in which fluid is supplied and exited from the machine, and the manner in which the sealing members 60 are forced to move radially inwardly and outwardly to maintain close sealing proximity with the periphery of the rotor 33. For the sake of simplicity the rotor in this embodiment is a solid rotor insofar as the side thrust balancing facility produced by the annular groove 69 and relief passage 70 as used in the embodiments of FIGS. 1 to 3 is omitted, although it can be included if necessary. Furthermore, the by-pass sleeve 42 with annular recess 73 and by-pass line 71 and valve chamber 72 as provided in the embodiment of FIGS. 1 to 3 to deal with the loss of oil or blowing of the oil seals 40 when the action of the machine is reversed making the input end the exit high pressure end, is also omitted, although it could be utilised if necessary. As shown, the annular space between the cylindrical wall 26 and the shaft 35 totally accommodates the packing seals 40 and the input end bearing 41*b*.

In the embodiment of FIG. 4 fluid is supplied to the machine via an inlet port 79 through the sidewall 25 of the housing 20 to which a supply conduit 80 is connected via a connector 81. The inner end of the inlet port 79 communicates with an annular groove 82 in, and around, the adjacent side face of the rotor 33, which in turn communicates with the radially directed transfer passage 55 via a transfer port 83. Fluid exits from the machine via a similar facility, namely, an exit port 84 through the sidewall 22 of the housing 20 to which an exit conduit 85 is connected via a connector 86, whilst the inner end of the exit port 84 communicates with an annular groove 87 in, and around, the adjacent surface of the rotor 33, where it in turn communicates with the radially directed transfer passage 59 via a transfer port 88. Also, in the embodiment of FIG. 4, the sealing members 60 are caused to move inwardly by compression springs 89 supported between the outer surfaces of the members 60 and the inside of the cover plates 90, and thus the support members 61 and the associated bearing pin and cam groove combinations 64, 65 of the embodiments of FIGS. 1 to 3 are dispensed with. The compression springs 89 continually bias the sealing members 60 into sealing sliding engagement with the peripheral surface of the rotor 33. Apart from the differences discussed above the construction and operation of the machine of FIG. 4 is the same as the machines of FIGS. 1 to 3 and where appropriate the same reference numerals have been used.

FIG. 5 is a simplified illustration of a twin rotor embodiment of the present invention which comprises an outer housing consisting of two cylindrical housing sections 94 defining two rotor cavities 95 separated by an annular partition wall 96 having a central circular hole 97 therethrough coincident with the axis of rotation of the machine. Two annular side walls 98 are provided at each end of the machine and have a central circular bore 99 therethrough coincident with the axis of rotation of the machine, whilst further integral cylindrical wall sections 100 are provided extending outwardly of the external sides of the side walls 98.

A pair of rotor bodies 101 as for the previous embodiments are provided within each cavity 95 and are supported, or formed integrally with, a common support shaft 102 having two end portions extending outwardly through the side walls 98 of the housing and passing through the circular holes 97 and 99. The space between the end portions of the support shaft 102 and the cylindrical wall sections 100 receive bearings 103 and packing seals 104, whilst the ends of the cylindrical wall sections 100 are closed by closure plates 105 attached thereto by bolts 106 and have holes 107 therethrough through which the end portions of the support shaft 102 pass. The various sections of the housing may be formed separately and bolted together by bolts 108 (one of which is shown), or alternatively any two or more sections of the housing may be formed integrally with each other and joined with other sections in a suitable manner.

A radially inwardly extending inlet passage 109 is provided in the partition wall 96 and within the wall itself divides into two axially extending passages 110 which are in communication with annular grooves 111 formed in the adjacent side surfaces of the rotors 101. The annular grooves 111 in each rotor 101 communicate with a substantially radially outwardly extending passage 112 which opens outwardly of the peripheral surface of the rotor on one side of the lobe portion of the rotor as with the previous embodiments. A radially inwardly extending exit passage 113 is provided in each rotor the opening to which is situated on the opposite side of the lobe portion as with the previous embodiments and communicates inwardly of the rotor with a single axial outlet passage 114 in the support shaft 102, which single axial outlet passage is in communication with the exit passages 113 in each rotor 101. As shown the axial outlet passage 114 is formed by boring an axial hole from one end of the support shaft 102 and placing a plug 115 therein.

The axial passage 114 communicates with a radially outwardly extending transfer port 116 through the support shaft 102 and communicates with an annular groove 117 around the hole 99 through the side wall 98, which annular groove 117 communicates with a radially outwardly extending exit passage 118 through the side wall 98. The inlet and outlet passages 109 and 118 communicate with respective inlet and outlet conduits 119 and 120 via connectors 121 and 122. Each of the rotors 101 cooperate with sealing members (not shown) as for the previous embodiments which may be adapted to move radially inwardly and outwardly by utilization of the means shown in the embodiments of FIGS. 1 and 2, or FIG. 4, and the operation of each rotor section is as previously described for the earlier embodiments and will be readily apparent from a consideration of those earlier embodiments.

The advantages of this twin rotor embodiment are that the lobe portions of the respective rotors and the sealing members to cooperate with each rotor are offset relative to each other by 180° thus dynamically balancing the whole unit. Thrust generated at right angles to the support shaft is also balanced, that is, the net thrust due to oil or fluid pressure on the outer surface of one rotor is opposed by an equal on opposite force from the other rotor surface. With such an arrangement the bearings for the machine are not unduly loaded. Furthermore as fluid is admitted to opposite sides of the two rotors, equal and opposite side thrusts are generated.

It will be understood that the inventive concept of the rotary machine may be adopted to a single compressor or pump arrangement whereby a gas or liquid to be compressed or pumped is induced, and compressed or pumped and delivered to a source where required, or if in the form of a hydraulic pump, may supply a hydraulic system which in turn may comprise hydraulic motors incorporating the features of the present invention.

The casing may be manufactured from any suitable engine, pump or compressor casing material such as aluminium alloy or even cast iron, whilst the internal surface may be suitably machined and hardened if necessary, and in the prototype of the machine produced all components have been manufactured from case hardened mild steel. The rotor could also be manufactured from similar material as the casing in order, particularly in the case of an engine application, to match the expansion and contraction of the casing during operation, whilst its circumferential surface may also be accurately machined. Closely adjacent surfaces of the rotor and housing which move in relative sliding sealing engagement or close sealing proximity are accurately machined to close tolerances (clearance of say less than ½ thousands of an inch) controlled by suitable linkages or stops to achieve sealing without actual contact, may be surface treated, including hardening treatments or pretreatment by modern dry lubricants, to reduce the incidence of wear of these parts, and supply oil free air although the presence of pressurised fluid in the system may reduce the necessity for actual sliding contact by virtue of the layer of fluid which may be interposed between the surfaces.

It should be observed that in the preferred embodiment previously described and particularly for the case of a rotary engine application, any pressure between the two sealing members during the period in which the gas is trapped between, or is trapped and being displaced, has no effect on the operation of the engine, since there is no change of volume, no change of position of the trapped medium, and no work has to be done except that amount of minor energy lost due to friction between the cylindrical surface of the rotor and the fluid medium and heat and turbulence caused thereby in the medium.

It will also be observed that the functions of the inlet and exit passages and ports need only be reversed to reverse the pumping direction, or the direction of the power thrust.

Two or more machines of different swept volumes may be used sharing a common shaft to form single machine stages as with a turbine. Furthermore the machine inlets and outlet passage may be provided directly through the support shafts for the rotor and connected to inlet and outlet conduits at the extreme ends of the shafts. In such an arrangement the shaft and rotor may be held against rotation such that the reaction forces generated will cause the housing to rotate during pumping or motor applications. It will be appreciated that the volume swept within the machine during operation thereof with the sealing members in a sealing position is constant thus providing a substantially continuous flow of working fluid. As stated previously the sealing members need only be in contact with the peripheral surface of the rotor when adjacent the circular non-lobe portion during each cycle and for the remainder of the cycle the means for moving the member radially inwardly and outwardly may provide for some spacing between the sealing members and the peripheral surface of the rotor such that the spaces on each side of the sealing member are interconnected during these non-sealing stages of the cycle whereby the movement of the sealing member through the working fluid does not produce pulsations as the sealing member are not displacing fluid when in their non-sealing positions.

As a pump the rotary machine can be used as a bilge pump for a boat, and in order to avoid rust, and wear due to sand or other particles the machine could be manufactured from plastics materials and/or stainless steel and/or rubber as in marine cutless bearings. With lower pressures applicable tolerances could be much greater. The water being pumped could act both as a lubricant and a coolant.

I claim:

1. A rotary machine including an outer housing, an annular surface in said housing and having a longitudinal axis, at least one rotor in said housing and rotatable about an axis coincident with the annular surface, said rotor having an outer surface including at least one sealing portion disposed in close sealing relation with the annular surface, said rotor surface having convexly curved cam surface portions on either side of said at least one sealing portion, said cam surface portions each merging into a segmental surface portion of the rotor surface concentric with the annular surface, at least two sealing members supported upon said housing and equally spaced around the annular surface, each said sealing member having a surface confronting said rotor outer surface and forming a sealing surface, said sealing surface being complementary to the segmental surface portion of said rotor for sealing engagement therewith, said sealing surface being non-complementary to the sealing portion and the cam surface portions of said rotor, means causing each said sealing member to move to position its sealing surface in sealing engagement with the segmental surface portion of said rotor when adjacent thereto, an inlet passage opening to the outer surface of said rotor predominantly through a cam surface portion and partly through a segmental surface portion on one side of said at least one sealing portion, an exit passage opening to the outer surface of said rotor predominantly through a cam surface portion and partly through a segmental surface portion on the other side of said at least one sealing portion, said inlet and exit passages communicating with ports for admitting working fluid to and exhausting working fluid from said housing, respectively, the length of the inlet and outlet passage openings at the outer rotor surface, when measured in the direction of rotor rotation, being greater than the length of the sealing surface for each said sealing member, whereby said inlet and outlet passages are continuously open to a respective working space between the rotor and the housing thereby maintaining substantially continuous and constant admission and exhaustion of working fluid during rotation of said rotor, the distance between the leading end of the opening of a said outlet passage and the trailing end of the opening of the inlet passage on the opposite side of the intervening segmental surface being greater than the distance between any pair of adjacent sealing members, whereby the inlet and outlet passages on either side of the intervening segmental surface portion will not be simultaneously open to the same working space between the pair of sealing members, the length of the at least one sealing portion of said rotor, when measured in the direction of rotor rotation, being greater than the length of the sealing surfaces for each sealing member, each said sealing member having at least one port therethrough opening through said sealing surface at one end and into a space within said housing at the surface of said sealing member opposite said sealing surface, whereby when each said sealing member is in sealing engagement with a majority of a said segmental surface portion of said rotor there will be no fluid flow through said port, but when each said sealing member is aligned with an inlet or outlet passage opening, including that part of the opening through said segmental surface portion, fluid flow occurs through said port to equalize fluid pressure at said sealing surface and said opposite surface of said sealing member.

2. A rotary machine as claimed in claim 1, wherein the length of each cam surface portion, when measured in the direction of rotation of said rotor, is greater than the length of the sealing surface for each sealing member.

3. A rotary machine as claimed in claim 1, wherein when said machine is used as a pump or compressor, means is provided for opposing the side thrust generated on the high pressure exit end of the mchine, said thrust opposing means comprising a transfer passage communicating with, and extending between, the exit passage from the machine and an annular groove in, and around, the opposite side of said rotor, said groove having a cross-sectional area substantially equal to the cross-sectional area of a support shaft for the rotor on the exit end of said machine.

4. A rotary machine as claimed in claim 1, wherein said housing contains at least two said rotors supported on a common support shaft and separated by at least one partition wall, each said rotor having a sealing portion and cooperating with respective sealing members and having inlet and outlet passages, said rotor sealing portions being equally circumferentially spaced apart within said housing to dynamically balance the forces imposed within the machine.

5. A rotary machine as claimed in claim 1, wherein said housing includes a cylindrical bore having a circumferential surface forming said annular surface, said rotor being rotatably disposed in said bore, said sealing portion including a lobe on the periphery of said rotor disposed in close sealing relation with the surface of the bore, said segmental surface portion including a segmental cylindrical surface equidistant from the bore surface, and means constraining said sealing member to move radially inwardly and outwardly of the bore.

6. A rotory machine as claimed in claim 5, wherein the outermost part of the lobe portion moves in sliding sealing engagement with the bore circumferential surface.

7. A rotary machine as claimed in claim 5, wherein said means for causing each sealing member to move comprises at least one support member extending radially inwardly of the rotor adjacent at least one side face thereof and carries at its inner end a bearing pin adapted to engage within a cam groove in the side face of the rotor whereby rotation of the rotor will cause the sealing member to execute the radially inwardly and outward movements in synchronism with the rotation of the rotor.

8. A rotary machine as claimed in claim 5, wherein the means for causing each said sealing member to move are compression springs supported between the sealing members and the outer ends of the guides within the housing.

9. A rotary machine as claimed in claim 5, wherein said rotor is supported within opposite ends of the housing by two support shafts extending from either side of said rotor, said inlet passage comprising a first portion extending axially of the machine through at least a portion of a first of said support shafts, a substantially radially outwardly directed second portion extending through the body of the rotor and communicating with the first portion while opening outwardly of said rotor through the peripheral surface thereof, said first portion of said passage communicating with an inlet cavity within said housing and surrounding said shaft via an inlet transfer port, said inlet cavity communicating with a working fluid supply port passing through the wall of said housing, said exit passage comprising an axial portion extending through the second of said support shafts, and a substantially radially directed portion communicating with said axial portion and extending through said rotor to open outwardly through the peripheral surface thereof, said axial portion communicating with a working fluid exit port provided through a cover plate for the end of said housing adjacent the end of said second shaft.

10. A rotary machine as claimed in claim 5, wherein said rotor is supported within opposite ends of the housing by two support shafts extending from either side of said rotor, said inlet passage having a first portion extending axially of the machine through at least a portion of a first of said support shafts, said inlet passage having a substantially radially outwardly directed second portion extending through the body of the rotor and communicating with the first portion while opening outwardly of said rotor through the peripheral surface thereof, said first portion of said passage communicating with an annular groove in the inner surface of the housing extending circumferentially thereabout, via a transfer port through said shaft, said groove communicating with a working fluid supply port extending radially through said housing, said exit passage comprising a first portion extending axially through the second of said support shafts and a substantially radially outwardly directed second portion extending through the body of said rotor and communicating with said first portion and opening outwardly through the peripheral surface thereof, said first portion communicating with a working fluid exit port provided through a cover plate for the end of said housing adjacent the end of said second shaft.

11. A rotary machine as claimed in claim 5, wherein said inlet passage comprises a substantially radially outwardly directed passage within said rotor and opening outwardly through the peripheral surface of the rotor, the inner end of said passage communicating with an annular groove in, and around, a side face of said rotor via a fluid transfer port, said annular groove communicating with a working fluid inlet port through an adjacent wall of said housing, said exit passage comprising a substantially radially outwardly directed passage in said rotor and opening outwardly through the peripheral surface of the rotor, the inner end of said passage communicating with an annular groove in, and around, a side face of said rotor via a fluid transfer port, said annular groove communicating with a working fluid outlet port through an adjacent wall of said housing.

* * * * *